US006398211B1

(12) United States Patent
Schalk

(10) Patent No.: US 6,398,211 B1
(45) Date of Patent: Jun. 4, 2002

(54) DEVICE FOR BRAKING PAPER SHEETS

(75) Inventor: Hubert Schalk, Thierhaupten (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/567,407

(22) Filed: May 8, 2000

(30) Foreign Application Priority Data

May 7, 1999 (DE) ..... 199 21 169

(51) Int. Cl.[7] ..... B65H 29/68
(52) U.S. Cl. ..... 271/182; 271/229
(58) Field of Search ..... 198/345.1; 271/182, 271/202, 270, 229

(56) References Cited

U.S. PATENT DOCUMENTS

| | | | | | |
|---|---|---|---|---|---|
| 1,404,554 | A | * | 1/1922 | Smith | 271/229 |
| 2,052,310 | A | * | 8/1936 | Lifsitz | 271/270 |
| 3,728,920 | A | * | 4/1973 | Gardner et al. | 83/106 |
| 3,882,744 | A | * | 5/1975 | McCarroll | 83/262 |
| 3,979,115 | A | * | 9/1976 | Bruckner et al. | 271/229 |
| 4,669,720 | A | * | 6/1987 | Rosati | 271/182 |
| 5,054,763 | A | * | 10/1991 | Achelpohl et al. | 271/182 |
| 5,316,286 | A | | 5/1994 | Takimoto | |

FOREIGN PATENT DOCUMENTS

| | | |
|---|---|---|
| DE | 1 183 439 | 12/1964 |
| DE | 1 214 249 | 4/1966 |
| DE | 2 000 078 | 7/1971 |
| DE | 72 19 031 | 8/1972 |
| DE | 2 202 334 | 7/1973 |
| DE | 26 01 081 | 7/1977 |
| DE | 83 17 604.7 | 3/1984 |
| DE | 43 07 383 | 9/1994 |
| EP | 675 010 | 10/1995 |
| EP | 702 276 | 3/1996 |

OTHER PUBLICATIONS

Herron, Cutforms Interruptor, IBM Technical Disclosure Bulletin vol. 15 No. 3 p. 785, Aug. 1972.*

* cited by examiner

*Primary Examiner*—H. Grant Skaggs
(74) *Attorney, Agent, or Firm*—Cohen, Pontani, Lieberman & Pavane

(57) ABSTRACT

A device for braking paper sheets, which acts on the paper sheets, including at least one resiliently movable brake shoe, and an electromagnet operatively arranged to impart a force on the brake shoe so that the brake shoe acts on the paper sheet.

16 Claims, 2 Drawing Sheets

A
1
2
3
4
5
6
7
8
9
10
11
2'
3'
4'
5'
6'
7'
8'

DEVICE FOR BRAKING PAPER SHEETS

BACKGROUND OF THE INVENTION

1. Field of the Invention

The invention relates to a device for braking paper sheets, in particular in printing machines.

2. Discussion of the Prior Art

In cross-cutting devices, individual paper sheets are cut out of paper webs and may be flat or else have one or more folds. These individual—collected or uncollected—products are conveyed by conveyor belts to further processing stations at the usually high machine speed. In order to ensure fault-free further processing, for example on folding tables, the products have first to be stopped or braked.

German Utility Model DE-G 8317604 discloses a braking device in which the braking action can be adjusted manually or automatically. As a result, the machine can be set up for the different requirements of various product thicknesses and lengths. Since, in the case of this device, the sheets are braked at their leading edge, the sheets back up and waves are formed on the individual sheets. During the further processing of these sheets in folding rolls, this leads to creases or other damage.

German reference DE-B 20 00 078 describes a device in which the sheets are conveyed one after another, at a distance, by high-speed lower belts to a braking device which acts on the underside of the trailing edge of the sheets. The sheets are braked by this device and then carried to the stacking point by belts running at the depositing speed. In order to be braked, the sheets are led over a stationary suction chamber which is provided with perforations and which brakes the trailing edge of the sheets by suction by being switched cyclically.

German reference DE-A 26 01 081 describes a braking device in which the trailing edges of the sheets are deflected downward out of the plane of the leading edge of the following sheet by means of an air stream directed counter to the sheet running direction, and are braked in the process. In the case of thin paper grades in particular, and at high machine speeds, it has been shown that the corners of the trailing edges of the sheets turn up during the braking operation and are caught, turned over and creased by the following sheet.

German reference DE-A 43 07 383 shows a braking device arranged underneath the entry plane of the sheets. The device leads an air stream counter to the sheet running direction through a slotted nozzle and over a guide plate. The trailing edges of the sheets are drawn downward and therefore braked by the air stream.

SUMMARY OF THE INVENTION

Accordingly, it is an object of the present invention to provide a device for braking paper sheets which is of uncomplicated construction, can be activated simply and which ensures fault-free further processing of the products.

Pursuant to this object, and others which will become apparent hereafter, one aspect of the present inventions resides in a device for braking paper sheets, which acts on the paper sheets, and includes at least one resiliently movable brake shoe, and an electromagnet operatively arranged to input a force on the brake shoe so that the brake shoe acts on the paper sheet.

By a means of the invention, the products can be braked and stopped at the rear, so that they are stretched and rest smoothly on the support, for example a folding table. The device according to the invention has an advantageous compact and simple construction with few components. Additionally, the device can advantageously be activated simply. The invention can be used flexibly, for example as a sheet brake on folding tables, as a brake in retardation stations or upstream of the compartments of paddle wheels, so that the products can advantageously be further processed undamaged.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
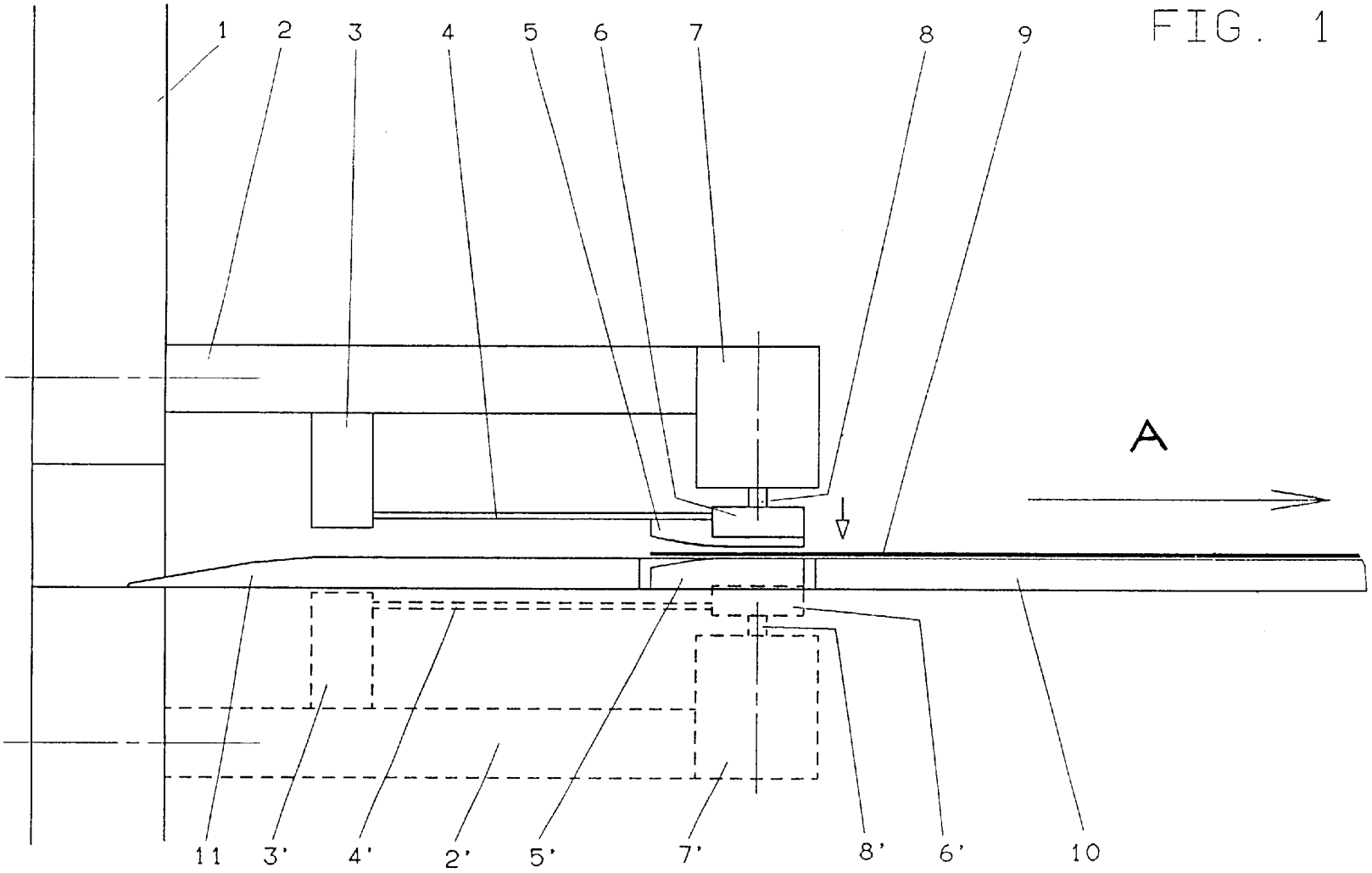
FIG. 1 shows the basic construction of the inventive braking device.

Paper sheets 9 are conveyed by conveyor belts (not shown in the drawing) over a rest 11, for example to a folding table 10 of a printing machine. These paper sheets 9 can be products cut out from paper webs by cross-cutting devices and can be unfolded or folded once or many times. These can be collected or uncollected products.

Fixed to a frame 1 is a support 2 which runs above and along the paper running direction. An electromagnet 7 is arranged on the support 2 at its end facing away from the frame 1. An armature 8 moves in its coil body 12—FIG. 2—preferably at right angles to the direction of sheet motion A and the surface of the paper sheets 9. At its end directed towards the course of the web, the armature 8 bears a brake shoe 6 to which a brake lining 5 is fixed. The brake shoe 6 is resiliently movably attached to the support 2 by a holder and a spring element 4, for example a leaf spring made of spring steel or polymer material.

Figure 2:
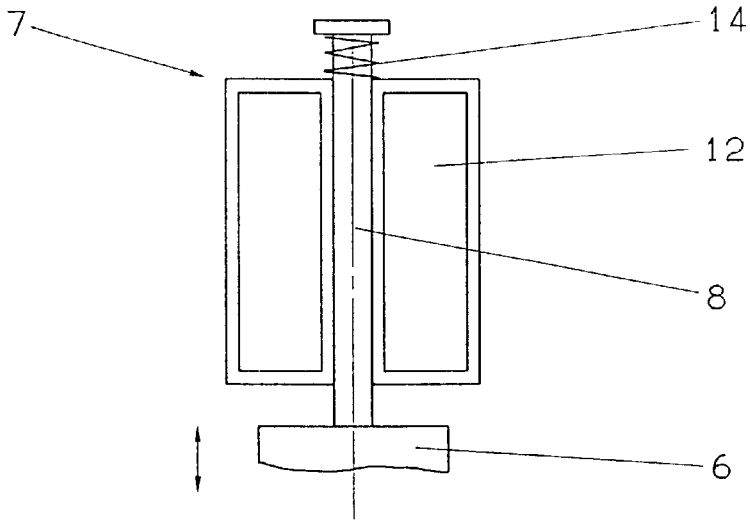
FIG. 2 is an enlarged view of the electromagnet.

However, a helical spring 14—FIG. 2—would also be conceivable which is held directly by the armature 8 and is supported both on the housing of the electromagnet 7 and on an extension to the armature 8.

By means of activating the electromagnet 7 electrically, a magnetic flux field is generated, the action of force from which causes the paper sheets 9 to be pressed by the armature 8, via the brake shoe 6 with its brake lining 5, against a further brake lining 5' arranged in a stationary manner on the rest 11.

As a result of the cyclic activation of the electromagnet 7, the braking force acts in a specific manner on the trailing edge of the paper sheet. As a result of the force of inertia, the paper sheet 9 is stretched in its direction of motion and is laid flat on the rest 11, which belongs, for example, to the folding table 10. After the braking force has been released, the braking device releases the paper sheet 9, by the brake lining 5 being lifted off the paper sheet 9 by the spring force of the spring element 4, 14 and moved into its initial position. The following paper sheet 9 can then run through under the brake lining 5 as far as its trailing edge, where then the braking force is brought into effect again.

The magnitude of the braking force can be adjusted by electric means.

Figure 3:
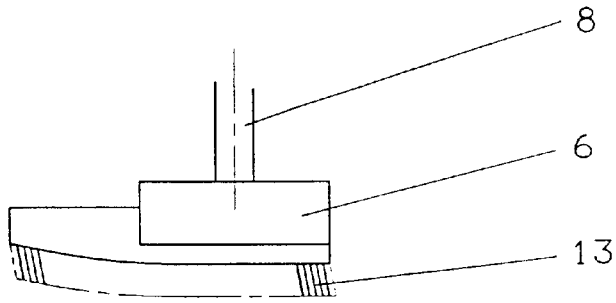
FIG. 3 is a view of the brake shoe.

The brake lining 5 has a beveled or rounded portion as an entry edge on its leading edge in the paper running direction. It preferably consists of a polymer with good sliding properties which does not tend to smearing on the surface of the products. However, a conventional brush 13—FIG. 3—can also be used as the brake lining 5.

In the embodiment previously explained, the braking device is arranged above the path of the paper run and presses the paper sheets 9, using one or more brake linings 5, against fixed brake linings 5' which are arranged underneath the path of the paper run.

Further designs provide for an opposite arrangement, in which the device 2', 3', 4', 5', 6', 7', 8') for braking the paper sheets 9 is arranged underneath the path of the paper run and operates against fixed brake linings which are fitted above.

In addition, designs are possible which are equipped with a braking device according to the invention both above and below the path of the paper run.

The device 2, 3, 4, 5, 6, 7, 8; 2', 3', 4', 5', 6', 7', 8' can be used flexibly and, in addition to the arrangement as a sheet stopper on folding tables 10, can also be used, for example, as a retardation station within the paper transport or upstream of the entry region into the compartments of paddle wheels.

The invention is not limited by the embodiments described above which are presented as examples only but can be modified in various ways within the scope of protection defined by the appended patent claims.

We claim:

1. A device for braking paper sheets, which acts on the paper sheets, comprising:

at least one resiliently movable brake shoe;

an electromagnet operatively arranged to impart a force on the brake shoe so that the brake shoe acts on the paper sheet;

a support upstream of the brake shoe in a paper running direction; and a leaf spring having a first end fixed to the support and a second end fixed to the brake shoe.

2. A device for braking paper sheets as defined in claim 1, wherein the electromagnet includes an electric coil former and an armature which can be moved in a controlled manner in a magnetic flux field of the electric coil former, the brake shoe being connected to the armature.

3. A device for braking paper sheets as defined in claim 1, wherein braking force and braking are adjustable.

4. A device for braking paper sheets as defined in claim 1, and further comprising a brake lining fixed to the brake shoe, the brake lining having an entry edge in an upstream area in a paper running direction.

5. A device for baking paper sheets as defined in claim 1, and further comprising a helical spring operatively mounted between the brake shoe and the electromagnet so that the brake shoe can be pulled back.

6. A device for braking paper sheets as defined in claim 1, and further comprising a brake lining fitted to the brake shoe.

7. A device for braking paper sheets as defined in claim 6, wherein the brake lining is a polymer layer.

8. A device for braking paper sheets as defined in claim 6, wherein the brake lining is a brush.

9. A device for braking paper sheets as defined in claim 1, wherein the brake shoe and the electromagnet are arranged above a path of the paper sheets.

10. A device for braking paper sheets as defined in claim 1, wherein the brake shoe, and the electromagnet are arranged underneath a path of the paper sheets.

11. A device for braking paper sheets as defined in claim 1, wherein the device is arrangable on a folding table so as to stop paper sheets.

12. A device for braking paper sheets as defined in claim 1, wherein the device is arrangable as a retarding station within a paper transport.

13. A device for braking paper sheets as defined in claim 1, wherein the device is arrangable upstream of an entry region of a paddle wheel compartment.

14. A device for braking paper sheets as defined in claim 1, wherein the brake shoe is arranged so as to act on trailing edges of the paper sheets.

15. A device for braking paper sheets as defined in claim 1, wherein the brake shoe is arranged to act on leading edges of the paper sheets.

16. A device for braking paper sheets, which acts on the paper sheets, comprising:

at least one resiliently movable brake shoe;

an electromagnet operatively arranged to impart a force on the brake shoe so that the brake shoe acts on the paper sheet the brake shoe, the electromagnet being arranged above a path of the paper sheets; and an additional brake shoe connected to an additional electromagnet, the, additional brake shoe and the additional magnet being arranged underneath the path of the paper sheets.

* * * * *